US011871822B2

(12) United States Patent
Almond et al.

(10) Patent No.: US 11,871,822 B2
(45) Date of Patent: Jan. 16, 2024

(54) BLISTER PACKAGE FOR CONTACT LENS

(71) Applicant: CooperVision International Limited, Fareham (GB)

(72) Inventors: Sarah Almond, Southampton (GB); Carlos Ortiz, Pittsford, NY (US); Gary Hunt, Bristol (GB); Mike Nelson, Bristol (GB); Russell Beard, Bristol (GB); Hayley Maynard, Bristol (GB); Thomas Harkin, Bristol (GB); Pauline Gavelle, Toulouse (FR)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 17/579,621

(22) Filed: Jan. 20, 2022

(65) Prior Publication Data

US 2022/0133007 A1 May 5, 2022

Related U.S. Application Data

(62) Division of application No. 16/737,937, filed on Jan. 9, 2020, now Pat. No. 11,253,035.

(Continued)

(51) Int. Cl.

*A45C 11/04* (2006.01)
*A45C 11/00* (2006.01)

(Continued)

(52) U.S. Cl.

CPC ..... *A45C 11/005* (2013.01); *B65B 25/008* (2013.01); *B65D 75/366* (2013.01); *B65D 75/58* (2013.01)

(58) Field of Classification Search

CPC .... A45C 11/005; B65D 75/366; B65D 75/58; B65B 25/008

(Continued)

(56) References Cited

U.S. PATENT DOCUMENTS 4,691,820 A 9/1987 Martinez
D299,085 S 12/1988 Martinez (Continued)

FOREIGN PATENT DOCUMENTS

AU 739045 B2 10/2001
EP 0734958 A1 10/1996

(Continued)

OTHER PUBLICATIONS

Extended European search report issued in corresponding European Patent Application No. 22175411.2 dated Sep. 12, 2022 (5 pages).

(Continued)

*Primary Examiner* — Luan K Bui

(74) *Attorney, Agent, or Firm* — Kilyk & Bowersox, P.L.LC.

(57) ABSTRACT

A blister package for a contact lens is provided. A deformable slider supporting a lens is movable via pull-tab or hinge to lift the contact lens out of a lens well. The deformable slider can include a hinge connected to a flexible peel-away top of the blister package or connected to a pull tab that can be pulled to pull taut the deformable slider. A blister package is also provided that includes a hinged shell having a lateral opening opposite the hinge, and a deformable slider that is folded over onto itself and seals both a top chamber and a bottom chamber. By pulling a tongue of the deformable slider, which extends from the lateral opening, the deformable slider can be removed from the closed shell and the closed shell can be opened enabling access to the contact lens.

12 Claims, 9 Drawing Sheets

Related U.S. Application Data

(60) Provisional application No. 62/845,358, filed on May 9, 2019, provisional application No. 62/795,288, filed on Jan. 22, 2019.

(51) Int. Cl.
*B65B 25/00* (2006.01)
*B65D 75/36* (2006.01)
*B65D 75/58* (2006.01)

(58) Field of Classification Search
USPC ..... 206/5.1, 804
See application file for complete search history.

(56) References Cited

U.S. PATENT DOCUMENTS

| | | | | |
|---|---|---|---|---|
| D305,478 | S | 1/1990 | Lahm et al. | |
| 5,069,494 | A | 12/1991 | Reinson et al. | |
| 5,409,104 | A | 4/1995 | Lovell | |
| 5,609,246 | A | 3/1997 | Borghorst et al. | |
| 5,620,088 | A | 4/1997 | Martin et al. | |
| 5,685,420 | A | 11/1997 | Martin et al. | |
| 5,697,495 | A | 12/1997 | Abrams et al. | |
| 5,704,468 | A | 1/1998 | Lust et al. | |
| 6,044,966 | A | 4/2000 | Haase | |
| 6,260,695 | B1 | 7/2001 | Tasber et al. | |
| 6,398,018 | B1 | 6/2002 | Livesley et al. | |
| 6,471,052 | B2 | 10/2002 | Faxe et al. | |
| 6,474,465 | B1 | 11/2002 | Jux | |
| 6,572,165 | B2 | 6/2003 | Faxe et al. | |
| 6,889,825 | B2 | 5/2005 | Ichikawa et al. | |
| 6,997,344 | B2 | 2/2006 | Brown et al. | |
| 7,086,526 | B2 | 8/2006 | Newman | |
| 7,168,746 | B2 | 1/2007 | Py | |
| 7,426,993 | B2 | 9/2008 | Coldrey et al. | |
| 7,431,152 | B2 | 10/2008 | Marmo | |
| 7,477,366 | B2 | 1/2009 | Clements et al. | |
| 7,699,161 | B2 | 4/2010 | Tokarski et al. | |
| 7,770,732 | B2 | 8/2010 | Stroppolo et al. | |
| 7,784,608 | B2 | 8/2010 | Tokarski et al. | |
| 7,789,266 | B2 | 9/2010 | Biel et al. | |
| 7,816,455 | B2 | 10/2010 | Marmo | |
| 7,938,255 | B2 * | 5/2011 | Newman | B65D 75/28 206/5.1 |
| 8,061,897 | B2 | 11/2011 | Ichikawa et al. | |
| 8,069,979 | B2 | 12/2011 | Newman et al. | |
| 8,281,920 | B2 | 10/2012 | Tokarski et al. | |
| 8,317,016 | B2 | 11/2012 | Tokarski et al. | |
| 8,459,445 | B2 | 6/2013 | Newman | |
| 8,833,548 | B2 | 9/2014 | Hsieh et al. | |
| 8,955,672 | B2 | 2/2015 | Newman | |
| 9,095,670 | B2 | 8/2015 | Briant et al. | |
| 9,119,450 | B2 | 9/2015 | Lee et al. | |
| 9,173,463 | B2 | 11/2015 | Clamp et al. | |
| 9,439,487 | B2 | 9/2016 | Barre et al. | |
| 9,655,423 | B1 | 5/2017 | Wang | |
| 9,701,458 | B2 | 7/2017 | Barrows et al. | |
| 9,839,270 | B2 | 12/2017 | Howell et al. | |
| D813,537 | S | 3/2018 | Miura et al. | |
| 10,092,075 | B2 | 10/2018 | Barre et al. | |
| 2003/0209452 | A1 | 11/2003 | Mitomo et al. | |
| 2006/0054514 | A1 | 3/2006 | Tokarski et al. | |
| 2006/0260957 | A1 | 11/2006 | Hamilton | |
| 2007/0102305 | A1 | 5/2007 | Tokarski et al. | |
| 2007/0119720 | A1 | 5/2007 | Marmo | |
| 2008/0047848 | A1 * | 2/2008 | Tokarski | B65D 75/366 206/5.1 |
| 2008/0078681 | A1 | 4/2008 | Newman | |
| 2009/0139879 | A1 | 6/2009 | Tokarski et al. | |
| 2010/0300902 | A1 | 12/2010 | Marmo | |
| 2012/0055817 | A1 | 3/2012 | Newman et al. | |
| 2012/0267262 | A1 | 10/2012 | Wang et al. | |
| 2014/0027465 | A1 * | 1/2014 | Howell | A45C 13/34 221/154 |
| 2014/0246337 | A1 | 9/2014 | Newman | |
| 2014/0262845 | A1 | 9/2014 | Newman | |
| 2015/0114851 | A1 | 4/2015 | English et al. | |
| 2015/0150346 | A1 | 6/2015 | Yasuda et al. | |
| 2016/0198825 | A1 * | 7/2016 | Fawdington | A45C 11/005 206/5.1 |
| 2017/0086552 | A1 | 3/2017 | Michalos | |
| 2017/0096272 | A1 | 4/2017 | Coon et al. | |
| 2017/0165901 | A1 | 6/2017 | Fischer et al. | |
| 2018/0125189 | A1 | 5/2018 | Barre et al. | |
| 2019/0008251 | A1 | 1/2019 | Kim | |
| 2020/0229560 | A1 | 7/2020 | Almond et al. | |
| 2020/0229562 | A1 | 7/2020 | Almond et al. | |
| 2020/0231351 | A1 | 7/2020 | Almond et al. | |

FOREIGN PATENT DOCUMENTS

| | | | |
|---|---|---|---|
| EP | 3045071 | A1 | 7/2016 |
| FR | 2913006 | A1 | 8/2008 |
| GB | 2285791 | A | 7/1995 |
| GB | 2551530 | A | 12/2017 |
| IT | MO20110255 | A1 | 4/2013 |
| JP | 2008253746 | A | 10/2008 |
| JP | 5466344 | B1 | 4/2014 |
| JP | 5676760 | B2 | 2/2015 |
| JP | 2016221059 | A | 12/2016 |
| LU | 88593 | A1 | 9/1995 |
| WO | 2006102450 | A2 | 9/2006 |
| WO | 2006105179 | A1 | 10/2006 |
| WO | 2009102273 | A1 | 8/2009 |
| WO | 2011112998 | A2 | 9/2011 |
| WO | 2012131786 | A1 | 10/2012 |
| WO | 2012168964 | A1 | 12/2012 |
| WO | 2013136361 | A1 | 9/2013 |
| WO | 2013153582 | A1 | 10/2013 |
| WO | 2014195588 | A1 | 12/2014 |
| WO | 2017137738 | A1 | 8/2017 |

OTHER PUBLICATIONS

International Search Report and Written Opinion issued in corresponding International Patent Application No. PCT/GB2020/050110 dated Jul. 17, 2020 (19 pages).

* cited by examiner

BLISTER PACKAGE FOR CONTACT LENS

This application is a divisional application of U.S. patent application Ser. No. 16/737,937, filed Jan. 9, 2020, which in turn claims the benefit under 35 U.S.C. § 119(e) of prior U.S. Provisional Patent Application No. 62/845,358, filed May 9, 2019, and U.S. Provisional Patent Application No. 62/795,288, filed Jan. 22, 2019, which are incorporated in their entirety by reference herein.

FIELD

The present invention relates to contact lens packaging and methods, and more specifically, to blister packages for sealed contact lenses containing unworn contact lenses, and methods of manufacturing contact lens packages.

BACKGROUND

Contact lenses, such as hydrogel and silicone hydrogel contact lenses, are frequently packaged in sealed blister packages or blister packs that permit storage of the unworn contact lenses in a sterile environment. For instance, a blister package which is adapted to provide a sterile sealed storage environment for a disposable or single-use hydrophilic contact lens, wherein the lens is immersed in a sterile aqueous solution, for example, such as in an isotonic saline solution, is described in Martinez, U.S. Pat. No. 4,691,820. Additional contact lens packages are disclosed in U.S. Pat. Nos. 4,691,820; 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

As an example of part of a manufacturing process, a newly manufactured unworn contact lens will be placed in a cavity or well of a plastic base member of a contact lens blister package, a contact lens packaging solution will be provided in the blister package cavity, and a foil sealing member will be adhered to the blister package to hermetically seal the contact lens in the packaging solution in the cavity. In other words, a contact lens blister package used in the manufacture of contact lenses contains a base member having a cavity or well, an unworn contact lens provided in a packaging solution within the cavity, and a sealing member sealed to the base member to provide an air tight seal around the perimeter of the cavity. The sealed blister package containing the contact lens is then autoclaved to sterilize the contact lens in the packaging solution in the cavity. The blister packs are understood to be primary packaging. Multiple blister packs are then placed in cartons. The cartons are considered secondary packaging.

Contact lens packages typically require a user to place a finger in the blister package cavity or well to pinch, slide, or otherwise manipulate the contact lens so it can be removed from the cavity. The contact lens then is positioned on a fingertip so it can be placed on an eye. Handling the contact lens, however, can introduce contaminants to the surface of the lens which can then be transferred to the eye. It can be appreciated that there remains a need to improve contact lens packaging, which, among other things, minimizes or eliminates the need for touching the contact lens before it is inserted onto a user's eye.

SUMMARY

The present invention addresses this need. As discussed herein, new contact lens packaging and methods of manufacturing packaged contact lenses are described. In general, as described herein, a contact lens package is provided. The contact lens package so described includes a plastic base member and a sealing member coupled to the base member to seal a contact lens in a cavity formed between the plastic base member and the sealing member. An unworn contact lens is provided in a contact lens packaging solution in the cavity. This sealed device is referred to herein as a sealed contact lens package or sealed contact lens blister package. The present sealed contact lens package, when opened, presents the contact lens in an orientation and posture that enables direct placement of the lens onto an eye without inverting the lens, or facilitates the placement of the lens on a fingertip for easy transfer of the lens to the surface of the eye, or both. No digging into a cavity or well or pinching of a sterile lens is required to remove the contact lens or to place the lens in a desired orientation for placement onto an eye, or both. Moreover, the present contact lens package, when opened, presents the lens in an orientation that does not require touching the inner, concave surface of the lens that, in use, directly contacts the surface of an eye.

According to an embodiment of the present invention, a blister package for a contact lens is provided, which blister package comprises a body defining a handle and a well, a flexible top contacting the body and closing the well, and a deformable slider comprising a lens support. The deformable slider is disposed between the body and the flexible top and is configured such that, by either pulling the deformable slider or peeling away the flexible top the lens support is lifted away from the bottom surface of the well and the lens is raised out of the well cradled or supported by the deformable slider.

The deformable slider can comprise a hinge connected to both the flexible top and the lens support and the blister package can be configured such that, by peeling the flexible top away from the body, the hinge is pulled taut causing the lens support to be lifted away from the bottom surface and enabling excess lens solution to drain back into the well.

The deformable slider can comprise a pull tab configured such that, after opening the blister package by peeling away the flexible top to expose the pull tab, the pull tab can be pulled to pull taut the deformable slider, lift the lens support, and enable excess lens solution to drain back into the well.

According to another embodiment of the present invention, the blister package comprises a hinged shell comprising a shell bottom, a shell top, a hinge connecting the shell bottom to the shell top, and a lateral opening along a side of the closed shell opposite the hinge. The shell bottom has a bottom inner sidewall that partially defines a bottom chamber, and a bottom chamber perimeter surface intersecting with the bottom inner sidewall. The shell top has a top inner sidewall that partially defines a top chamber, and a top chamber perimeter surface intersecting with the top inner sidewall. The hinged shell is configured such that the shell bottom and the shell top can be closed together to form the closed shell having the lateral opening. According to such an embodiment, the deformable slider is folded over onto itself at a fold, is substantially enclosed in the closed shell, and comprises a bottom surface that seals the bottom chamber and is folded-over to seal the top chamber. The deformable slider extends from the lateral opening of the closed shell. By pulling the tongue, the deformable slider can be removed from the closed shell, causing the top chamber to drain into the bottom chamber, drop the lens onto a grate above the bottom chamber, and present the lens on top of the grate so the lens can be contacted with a fingertip once the shell is opened.

Other aspects and details of the present invention will be apparent based on the following drawings, detailed description, and claims.

DETAILED DESCRIPTION

Figure 1A:
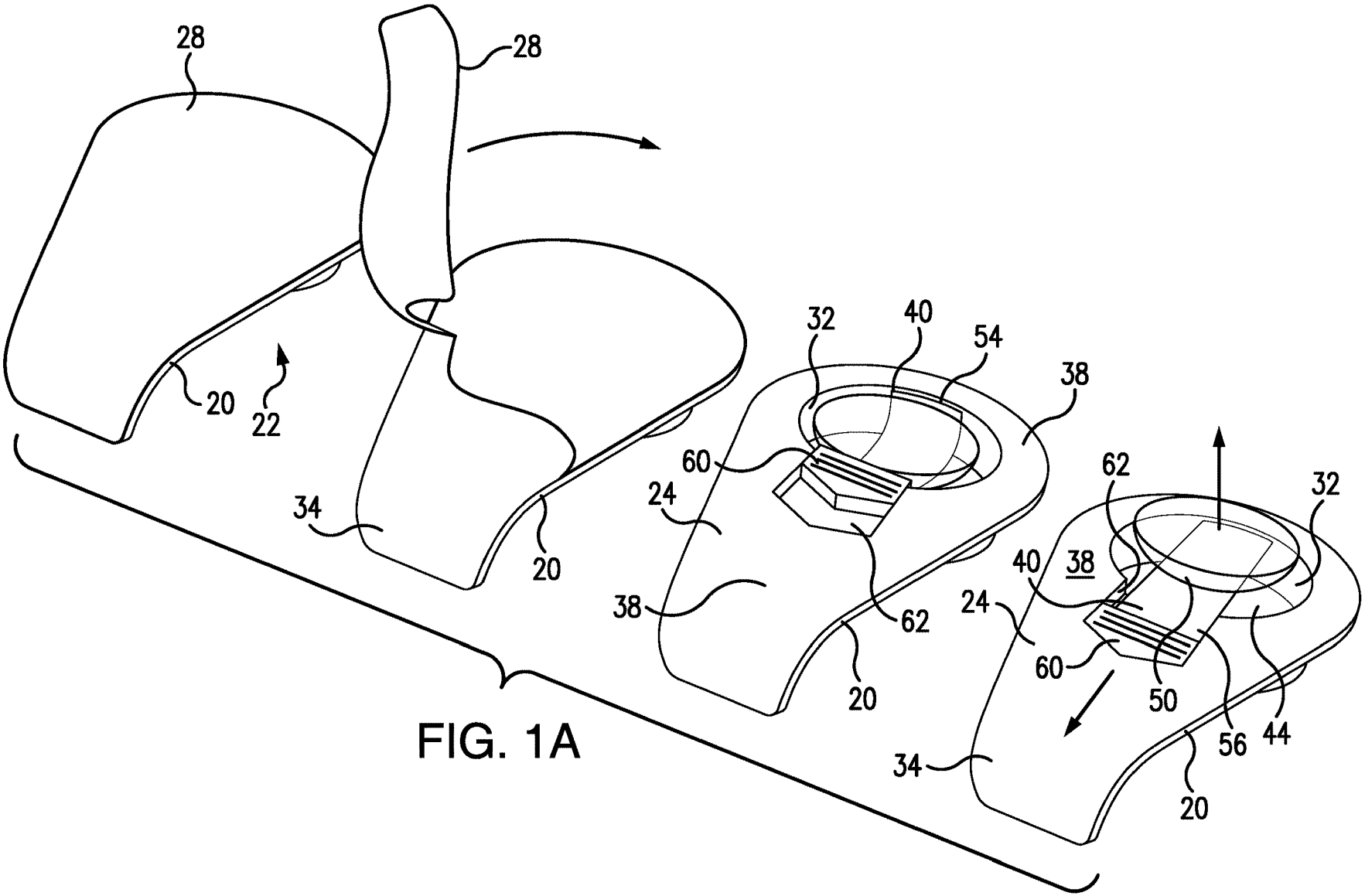
FIGS. 1A and 1B show series of steps involved with opening a blister package and tightening a deformable slide according to embodiments of the present invention.

According to the present invention, a blister package for a contact lens is provided. The blister package comprises a body defining a handle, a well connected to the handle, and a body top surface. The well has a perimeter and an inner sidewall defining a bottom surface. A flexible top is provided contacting the body top surface around the perimeter of the well and closing the well. The flexible top has a peel tab and can be peeled away from the body to open the well. The blister package can comprise a deformable slider. The deformable slider can comprise a lens support. The lens support can comprise, for example, a dome, a hemisphere, or a pad made of, or comprising a compressible material, a foam material, an open-cell foam, a closed-cell foam, a polymeric material, a rubber material, an elastomeric material, or a combination thereof, or the like. The lens support can have a circular shape and a diameter. The lens support can be disposed in the well and adjacent to the bottom surface. The deformable slider can be disposed between the body and the flexible top. The deformable slider can be configured such that, by pulling the deformable slider, the lens support is lifted away from the bottom surface.

The deformable slider can be connected to the flexible top, the lens support, both, or neither. The deformable slider can comprise a hinge and the hinge can be connected to both the flexible top and the lens support. The blister package can be configured such that, by peeling the flexible top away from the body, the hinge is pulled taut causing the lens support to be lifted away from the bottom surface and enabling excess lens solution to drain back into the well. The peel tab of the flexible top can contact the body on a first side of the well, and the hinge can be connected to the flexible top adjacent a second side of the well, for example, wherein the second side is opposite the first side. The blister package can be configured such that, by peeling the flexible top away from the body, the well is exposed prior to the hinge being pulled taut. Pulling the flexible top in a direction from the first side to the second side can cause the lens support to be lifted away from the bottom surface.

The deformable slider can comprise a unitary sheet of material, a multi-layer sheet of material, a foil material, a plastic material, a combination thereof, or the like. The deformable slider can comprise a foil material. Each of the flexible top and the deformable slider can independently comprise a foil material. The material of the flexible top and the material of the deformable slider can be the same or can be different. The deformable slider can be a part of or separate from the flexible top. The blister package can be configured such that peeling away the flexible top from the body can expose the deformable slider.

The deformable slider can further comprise a pull tab. The flexible top can be sealed to the body top surface with the pull tab sealed between the body top surface and the flexible top, or the pull tab can be exposed when the flexible top is sealed to the body top surface. The pull tab can be configured such that, after opening the blister package by peeling away the flexible top, the pull tab can be exposed. Pulling the pull tab can pull taut the deformable slider, uncover, release, or otherwise cause a lifting of the lens support, and enable excess lens solution to drain back into the well. The pull tab can comprise a rail, the body can comprise a groove, and the rail can be slidable in the groove. Pulling the pull tab can comprise sliding the rail of the pull tab in the groove.

The blister package can comprise a contact lens in the well and supported by the lens support. Contact lens solution can also be included in the blister package, for example, a sterile, packaging solution such as a saline solution.

The present invention also provides a method of packaging a contact lens. The method comprises placing a contact lens into a well of a blister package, on top of a lens support of a deformable slider. The blister package can comprise a body having a handle, a well connected to the handle, and a body top surface. The well can have a perimeter and an inner sidewall defining a bottom surface. An exemplary blister package that can be used in carrying out the method is a blister package of the present invention, for example, as described above. The method can comprise sealing a flexible top to the body top surface to seal the well with the contact lens therein, on top of the lens support. The step of sealing can comprise sealing the flexible top such that the flexible top contacts the body top surface around the perimeter of the well and closes the well. The flexible top can have a peel tab that can be peeled away from the body to open the well. The lens support can be disposed in the well and adjacent the bottom surface. The deformable slider can be configured such that, by pulling the deformable slider, the lens support is lifted away from the bottom surface.

The deformable slider can comprise a hinge. The deformable slider can be folded over on itself and the hinge can be defined by the fold. The hinge can be connected to the both the lens support and to the flexible top. The method can comprise pulling the pull tab and pulling the pull tab can result in any of a number of actions. Pulling the pull tab can (1) peel the flexible top away from the body top surface. Pulling the pull tab can (2) open the well. Pulling the pull tab can (3) pull taut the hinge. Pulling the pull tab can (4) lift the lens support away from the bottom surface and enable excess lens solution to drain back into the well. Moreover, pulling the pull tab can result in all four actions ((1)-(4)) being carried out.

The method can further comprise opening the blister package by peeling away the flexible top and pulling taut the deformable slider to lift the lens support and cause excess lens solution to drain back into the well. If the deformable slider is connected to the flexible top, the method can further comprise pulling the pull tab to peel away the flexible top from the body top surface, lift the lens support away from the bottom surface of the well, and enable excess lens solution to drain back into the well.

The deformable slider can comprise a pull tab. The step of sealing the flexible top to the body top surface can comprise sealing the pull tab between the body top surface and the flexible top. The method can further comprise opening the blister package by peeling away the flexible top and pulling the pull tab to pull taut the deformable slider and lift the lens support. Pulling taut the deformable slider can lift the lens support and enable excess lens solution to drain back into the well. The pull tab can comprise a rail and the body can comprise a groove. The rail can be slidable in the groove, and the step of pulling the pull tab can comprise sliding the rail of the pull tab in the groove.

In yet another embodiment of the present invention, a blister package for a contact lens is provided, which comprises a hinged shell. The hinged shell can comprise a shell bottom, a shell top, and a hinge connecting the shell bottom to the shell top. The shell bottom, shell top, and hinge can be formed together as one piece, for example, integrally molded together, or the shell bottom and shell top can be made separately and joined together by the hinge, for example, with one of the top and bottom comprising a connected rail and the other of the top and bottom comprising an open groove for receiving the rail. The shell bottom can have a bottom inner sidewall that partially defines a bottom chamber, and a bottom chamber perimeter surface intersecting with the bottom inner sidewall. The shell top can have a top inner sidewall that partially defines a top chamber, and a top chamber perimeter surface intersecting with the top inner sidewall. A contact lens can be sealed within the top chamber. The hinged shell can be configured such that the shell bottom and the shell top can be closed together to form a closed shell having a lateral opening.

Together with the hinged shell, the blister package can comprise a deformable slider. The deformable slider can comprise a foil material, a plastic material, a unitary sheet of material, a combination thereof, or the like. The deformable slider can be folded over onto itself at a fold. The deformable slider can be substantially disposed, enclosed, or encased within the closed shell. The deformable slider can comprise a bottom surface sealing the bottom chamber at the bottom chamber perimeter surface, be folded over onto itself, and seal the top chamber at the top chamber perimeter surface. The deformable slider also comprises a tongue extending from the lateral opening of the closed shell. A lens support can be provided in the bottom chamber, for example, a grate extending across a top of the bottom chamber. In use, by pulling the tongue to remove the deformable slider from the hinged shell, through the lateral opening, the seals (1) between the deformable slider and the top chamber perimeter surface, and (2) between the deformable slider and the bottom chamber perimeter surface, can be broken and the deformable slider can be peeled away from and out of the hinged shell. Liquid contents in the top chamber can then flow or drain into the bottom chamber and, when the shell is opened, the contact lens can be supported by the lens support at the top of the bottom chamber. The contact lens is presented in an orientation ready to be contacted by a fingertip of a user and transferred onto an eye.

A contact lens and lens solution can be sealed within the top chamber. The lens support can comprise a drain and the blister package can be configured such that, by pulling the pull tab out of the closed shell, through the lateral opening, the seal between the deformable slider and the top chamber perimeter surface is broken. The seal between the deformable slider and the bottom chamber perimeter surface is also broken. The contact lens solution can then be drained from the top chamber into the bottom chamber. The closed shell can then be opened to present the contact lens on the lens support above the bottom chamber.

According to the present invention, a contact lens can be positioned or disposed in the top chamber, along with contact lens solution, for example, while the top chamber is in an inverted or upside-down orientation. The deformable slider can then be sealed to the top chamber perimeter surface and to the bottom chamber perimeter surface, to form a sealed blister package. The shell bottom and the shell top can then be closed together to form a closed shell having a lateral opening. To open the blister package, the deformable slider can be pulled out of the lateral opening by pulling on the tongue, and then the hinged shell can be opened. The lens support can comprise a drain and the method can further comprise draining the contact lens solution out of the top chamber. The action of pulling the pull tab out of the closed shell, through the lateral opening, can (1) break the seal between the deformable slider and the top chamber perimeter surface, (2) break the seal between the deformable slider and the bottom chamber perimeter surface, and (3) drain the contact lens solution into the bottom chamber. The closed hinged shell can then be opened, presenting the contact lens on the lens support at the top of the bottom chamber.

The blister package body includes a well for containing a contact lens immersed in an amount of a solution. The term "contact lens" as used herein is intended to embrace an ophthalmic lens which is to be worn on or in the eye of an individual. The top surface of the body includes a peripherally located perimeter region at least partially surrounding an opening of the well. The handle can include a grip region. The flexible top is designed to cover and sealingly enclose the contact lens and solution within the well.

The body of the blister package can be formed of a plastic material that can be shaped by injection molding or thermoforming. For example, the plastic material used to make the body can comprise polypropylene, polyethylene, polystyrene, or another thermoplastic material. One or more portions of the body material, particularly in the well, can have a vapor transmission of less than 10 grams/100 square inches/24 hours at 70° F. and 50 percent relative humidity.

As stated above, the body of the blister package can comprise a variety of structures, such as a relatively rigid material or a flexible material. The base member of the sealed blister package can be a thermoplastic material or an injection molded material, and the base member can include a well and a substantially planar body top surface surrounding the well. The substantially planar body top surface provides a sealing surface for sealing the flexible top. The body can be made from a variety of materials. The body can be formed using conventional methods and equipment, such as by injection molding polypropylene resin into body molds in an injection molding machine. The flexible top can also be formed from a variety of materials. For example, the flexible top can be a laminated structure comprising a foil and one or more layers of plastic, such as polypropylene and the like. The flexible top can include human readable information, as desired. The flexible top can be coupled to the body top surface by contacting the sealing surface of the body with the flexible top and applying heat to fuse the two members together to provide a hermetic or airtight seal for the contact lens and the packaging solution in the well.

The perimeter of the well can be contiguous with the circumference of the well. The perimeter can include a flange region, for example, extending about 5 mm from the opening of the well to a grip region. In an exemplary embodiment, the overall dimensions of the blister package can be approximately 30 mm wide, about 47 mm long and about 10 mm high. It should be appreciated, however, that the package can have any size and/or shape.

The well holds in a fluid tight manner, a contact lens and solution. The well is bounded by a seal area that is part of the flange region. The flexible top can be attached to the body by heat-sealing in the seal area; however, induction-sealing, sonic welding, or other bonding systems can be used to attach the flexible top to the body. The total interior volume defined by the well, once sealed, can be about 2.2 ml or less. The total interior volume can be, for example, from about 0.5 ml to about 2.5 ml.

The flexible top can comprise at least two elements, for example, at least two different, separate layers of material. For example, the flexible top can comprise a first member, or first layer, and a second member, or second layer overlaying the first member. The first member can be made of a laminate material that is heat sealed to the seal region of the blister package body. The second member can comprise a foil material, sealed to the rim portion of the body. The second member can comprise at least one, for example two, polymer layers, e.g. polypropylene, coating the foil. The foil can comprise aluminum. The polymer coating material on the heat seal side of the foil can be polypropylene. Examples of useful cover layers are described in U.S. Pat. No. 4,691,820 that is incorporated herein in its entirety by reference. The second member can be sealed to the body along an entire circumference of the body surrounding the well, so as to provide a sanitary or sterile covering, for example, by means of a hermetic seal.

The deformable slider can comprise one, two, or more different, separate layers of material. The deformable slider can be made of a laminate material. The deformable slider can comprise a polymer or polymer layer, a homopolymer layer, polypropylene, polyethylene, another polyalkylene, an elastomeric material, a silicone rubber, a vulcanized rubber material, a rubber band material, a foil layer, a combination thereof, or the like.

The deformable slider can be configured to stretch across the well, for example, from a proximal side of the well, adjacent to the handle, to a distil side of the well, opposite the proximal side. The deformable slider can be configured to be pulled taut from a beginning, relaxed position into a lifted, stretched-out position whereby a contact lens in the blister package body is raised out of the well and presented. The deformable slider can be attached to the proximal side of the well, attached to the distal side of the well, or both. The deformable slider can be attached across any two sides or portions of the sidewall of the well. By attachment to the side of the well, what is meant is attached to an inner sidewall portion of the well, to an edge of the well adjacent to the well opening, to the top surface of the blister package body at or near an edge of the well, or a combination thereof.

The deformable slider can be, and remain during use, attached at an end to the distal side of the well, while an opposite end of the deformable slider, adjacent to the proximal side of the well, is pulled taut. Pulling taut can involve, for example, being slid laterally such as toward the handle. For example, the deformable slider can be tensioned by the action of pulling a pull tab operatively connected to the deformable slider. The deformable slider can be adhered to, bonded to, formed integral with, attached to, or otherwise affixed to the pull tab. Movement, for example, sliding movement, lateral movement, or the like, can affect tensioning of the deformable slider. The deformable slider can be, and remain during use, attached to the proximal side of the well and can be pulled taut by movement at or adjacent to the distal side of the well. For example, the deformable slider can be tensioned by the action of pulling away the flexible top from the top surface of the blister package body.

The deformable slider can be pulled taut so as to rise up from the bottom of the well, by being pulled in any direction. For example, the deformable slider can be pulled taut by movement of a proximal end of the deformable slider toward the handle, by movement of a distal end of the deformable slider away from the handle, by movement transversely across the well or orthogonally relative to the longitudinal axis of the blister package, by a combination thereof, or the like.

An unworn contact lens is sealed within the well of the sealed contact lens blister package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, fanfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, and the like.

The fluid medium or solution contained in the well (i.e., the packaging solution) can be any known solution useful for storing contact lenses including water, saline solutions, or buffered aqueous solutions. The contact lens and solution will preferably fill at least 50 percent, for example, at least 70 percent or at least 80 percent, of the total volume defined by the well once sealed by the flexible top.

The contact lens packaging solution is typically a buffered saline solution, such as a phosphate buffered saline solution or a borate buffered saline solution, that can contain one or more additives, such as surfactants, wetting agents, viscosity agents, and the like.

The blister package can also include a wrap that has one or more panels. The wrap can be dimensioned to accommodate the sealed contact lens package and to also provide a UDI in both human readable form and machine readable form, in addition to other required regulatory information. As used herein, a UDI is a "Unique Device Identifier". As used herein, a wrap refers to a substrate or article comprising one or more panels coupled to a sealed contact lens package, and a UDI in both human readable form and machine-readable form is provided on at least one of the panels. Such a wrap can be understood to be a "UDI wrap", or it can be understood to be a wrap having a "UDI panel". Thus, the wrap includes human readable information, such as letters, numbers, and images; and the wrap includes machine readable information, such as bar codes and the like. The wrap can be flexible or rigid and does not need to fully enclose or surround the individual sealed contact lens package. The wrap is coupled to the sealed contact lens package so that the wrap and sealed contact lens package do not become separated until a person opens the package to remove the unworn contact lens. For example, the wrap can be adhered to the sealed contact lens package, such as by using an adhesive between a surface of the wrap and a surface of the sealing member, or the wrap can be physically wrapped around the sealed contact lens package to mechanically enclose the sealed contact lens package within the wrap. Thus, the wrap cannot be inadvertently dislodged or separated from the sealed contact lens blister package.

Examples of blister package materials, methods of making blister package bodies, flexible tops, methods of making flexible tops, methods of sealing flexible tops to bodies, as well as other helpful components, materials, methods, and systems are described, for example, in U.S. Pat. Nos. 6,398,018, 7,426,993 B2, and 7,477,366 B2, in U.S. Patent Application Publications Nos. US 2012/0061260 A1, and US 2017/0096272 A1, and in WO 2013/160667, each of which is incorporated herein in its entirety by reference.

Figure 1B:
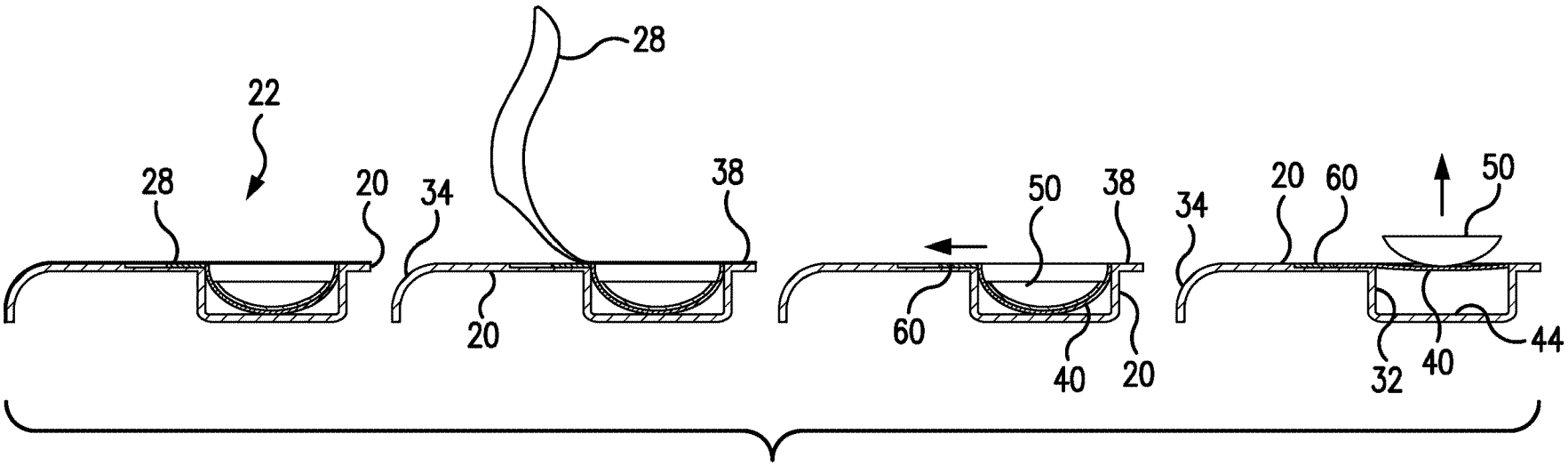

With reference to the drawing figures, each of FIGS. 1A and 1B illustrates the sequential steps involved with opening a blister pack 20 according to an exemplary embodiment of the present invention. FIG. 1A shows the same single blister pack 20 at four different points of time during an opening procedure. To the far left of FIG. 1A and FIG. 1B is a new, unopened, and unpeeled blister package 22. Blister package 22 comprises a body 24 and a flexible top 28 sealing a contact lens within a well 32 shown in the last two states of the sequence. Body 24 defines well 32 and a handle 34. In the third state shown, from the left, in both FIGS. 1A and 1B, flexible top 28 has been completely removed from a top surface 38 of body 24. As can be seen in the third state from the left, a deformable slider 40 lies in a loose condition inside well 32 and conforms to a bottom surface 44 of well 32. As shown in the third state from the left, the deformable slider 40 stretches across well 32 and forms a cradle on which a contact lens 50 rests. One end 54 of deformable slider 40 is attached, or otherwise connected, at or near the top of the sidewall defining well 32. An opposite end 56 of deformable slider 40 is attached or otherwise connected to a pull tab 60 that is designed to be pushed or pulled in a tab channel 62 formed in body 24. Pull tab 60, although referred to as a "pull" tab, includes gripping ridges thereon and can be pulled or pushed to the extended position illustrated in the state of the blister pack shown to the far right, wherein deformable slider 40 is pulled taut, contact lens 50 is elevated out of well 32, and excess lens solution drains back into the well. Pull tab 60 can include engagement features (not shown), for example, rails or grooves, and tab channel 62 can have complimentary engagement features (not shown), for example, grooves or rails. The engagement features of pull tab 60 and of tab channel 62 can work together to guide and stop the extension and tightening of deformable slider 40.

With particular regard to FIG. 1B for which the same reference numerals as used in FIG. 1A denote the same features, the last two states shown appear to be sequential. In practice, however, movement of pull tab 60 to tighten the deformable slider 40 causes a simultaneous lifting of contact lens 50 out of well 32. Thus, it is to be understood that the last two steps shown in FIG. 1B occur simultaneously.

Figure 1C:
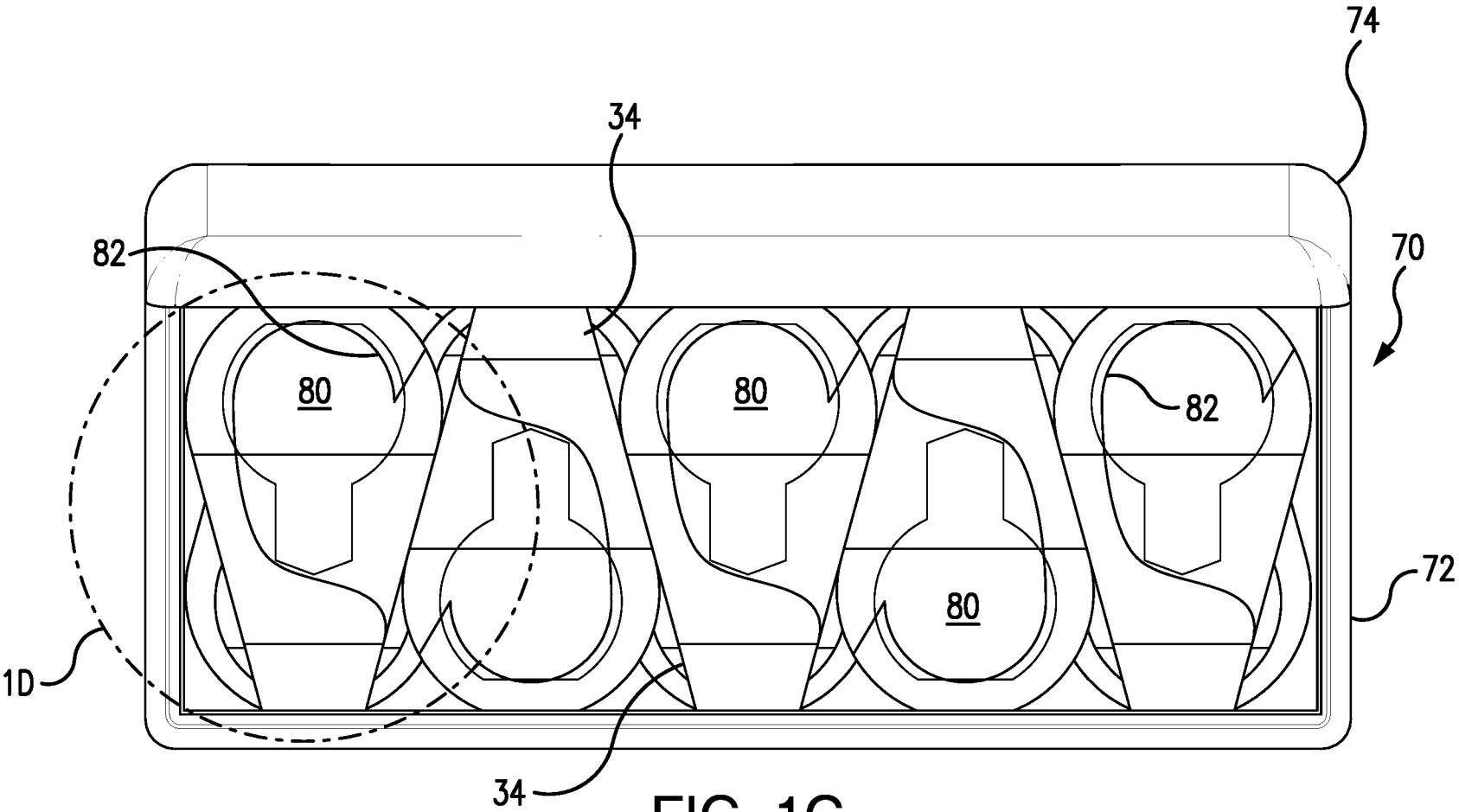
FIG. 1C shows a secondary package containing a plurality of blister packages as shown in FIGS. 1A and 1B.
Figure 1D:
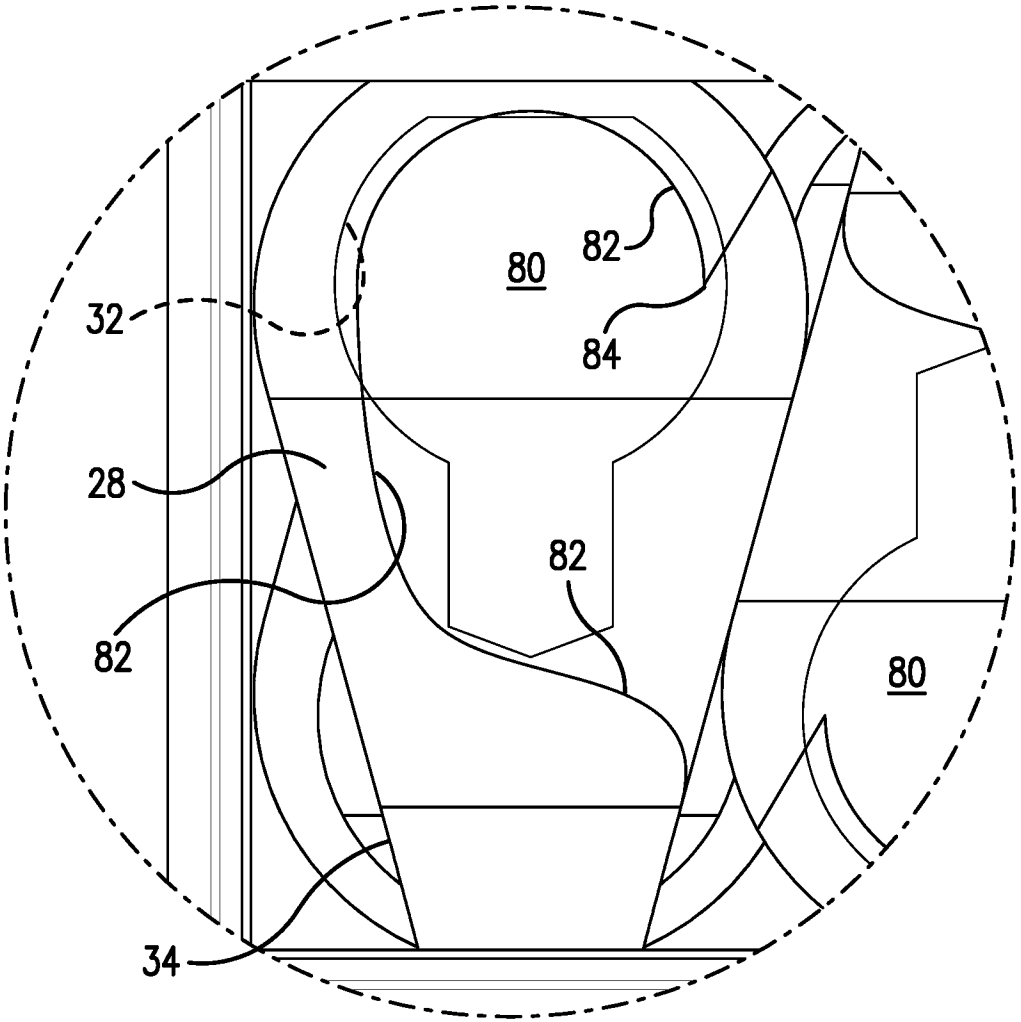
FIG. 1D is an enlarged view of a stack of blister packages shown in FIG. 1C and taken from section 1D shown in FIG. 1C.

FIG. 1C is a top view of an open blister package container 70 holding therein a plurality of blister packages 80 packed in an alternating fashion. Alternating the blister packages from bottom to top to form stacks, and alternating the stacks from left to right in container 70, most efficiently packs the multitude of blister packages 80 within container 70. The stacks can be of any height, for example, three blister packages high, four blister packages high, six blister packages high, or the like. As can be seen, container 70 has a body 72 and a hinged lid 74. An enlarged top view the farthest left blister package stack is shown in FIG. 1D. FIG. 1D is taken from section 1D shown in FIG. 1C. As can be seen in FIG. 1D, the blister packages are stacked and are arranged in an alternating fashion from bottom to top. The stacks are arranged, as shown in FIG. 1C, in alternating orientations from left to right in container 70. In FIGS. 1C and 1D, the same reference numerals as are used in FIGS. 1A and 1B denote the same features.

In both FIGS. 1A and 1B, it can be seen that deformable slider 40 is, and remains, attached at the distal end thereof to a distal side of well 32. The attachment can be along the edge of well 32 adjacent to or at the distal side of well 32, which is located in the vicinity of the lead line for reference numeral 38. Meanwhile, the proximal end of deformable slider 40, which is attached to pull tab 60, is not attached to the proximal side of well 32 but rather traverses well 32 and is configured to be slid in a direction toward handle 34. The deformable slider and pull tab can be moved in the direction indicated by the horizontally depicted directional arrow shown in FIG. 1B. In doing so, deformable slider 40 can be tensioned across the well, for example, completely across a diameter of well 32.

As can be seen, pull tab 60 can be pulled toward handle 34, causing deformable slider 40 to be pulled taut such that contact lens 50, resting on deformable slider 40, is elevated out of well 32. As shown all the way to the right in FIG. 1B, once pull tab 60 is pulled as far as it is configured to go, deformable slider 40 stretches across the entirety of well 32 from the distal side of well 32 toward and past the proximal side of well 32. The width of deformable slider 40, and the orientation of deformable slider 40, can be, such that, when stretched across well 32, the entirety of a diameter of well 32 is traversed by deformable slider 40. Deformable slider 40 can be slid horizontally or laterally, at a proximal end thereof, while remaining connected or attached to the distal side of well 32. As such, deformable slider 40 is stretched, tightened, and raised away from bottom 44 of well 32 as shown sequentially in each of FIGS. 1A and 1B.

As can best be seen by the enlarged view of FIG. 1D, flexible top 28 can be separated from the blister package body at handle 34 and then can be pulled in a direction toward well 32 tearing along a score line 82 in a manner that enables the user to peel away flexible top 28 in a circular motion. Score line 82 enables more control and less force to peel away flexible top 28 when compared with a design that does not include a score line. Score line 82 is formed, in large part, inside and conforming with the perimeter of well 32 such that, by the time flexible top 28 is peeled away from the top surface of the blister package body to a location 84, very little of flexible top 28 remains attached to top surface 38 (FIGS. 1A and 1B). The very little bit of flexible top 28 remaining attached to the top surface can be peeled away with very little effort.

Figure 2A:
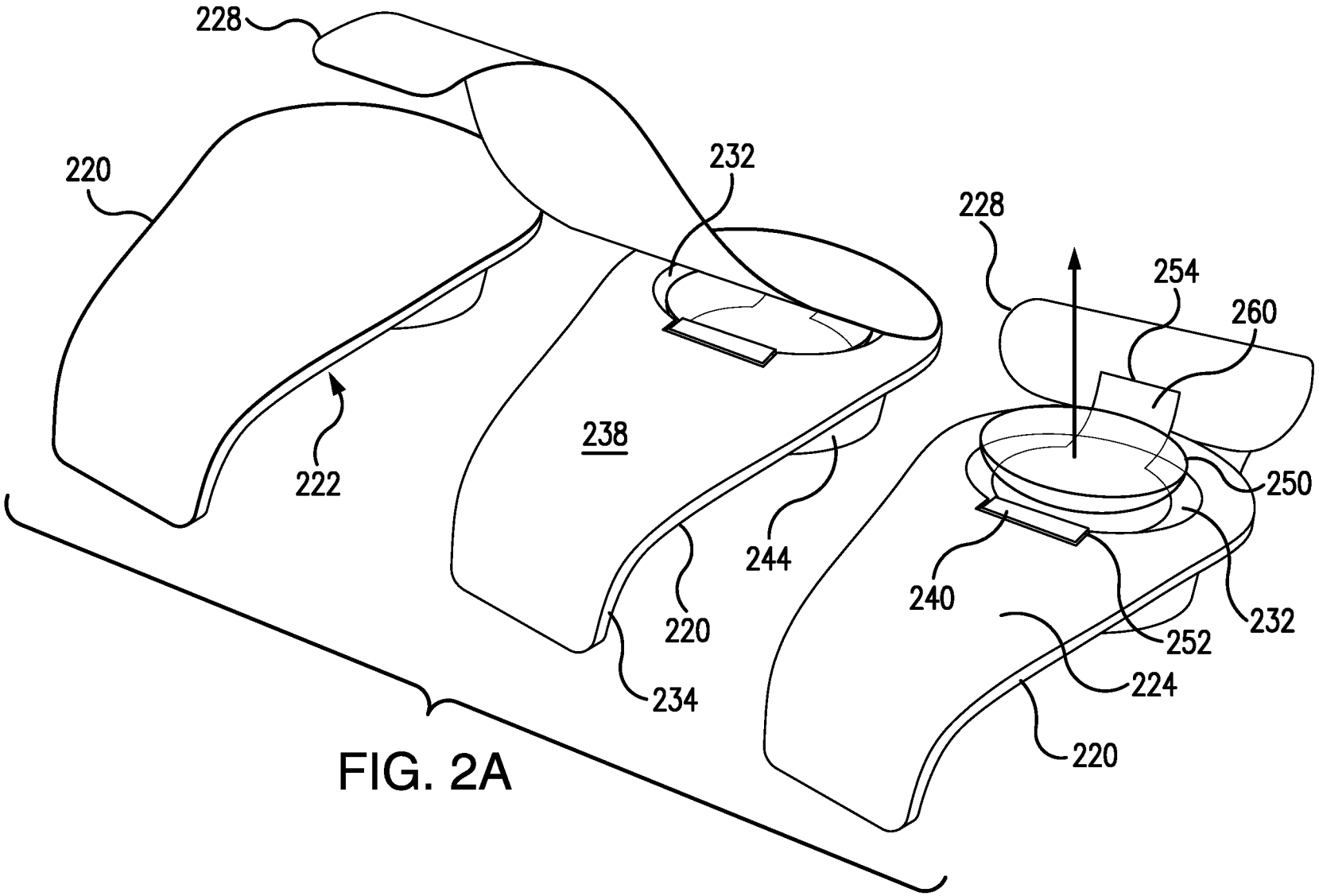
FIGS. 2A and 2B show series of steps involved with opening a blister package and tightening a deformable slide according to another embodiment of the present invention.
Figure 2B:
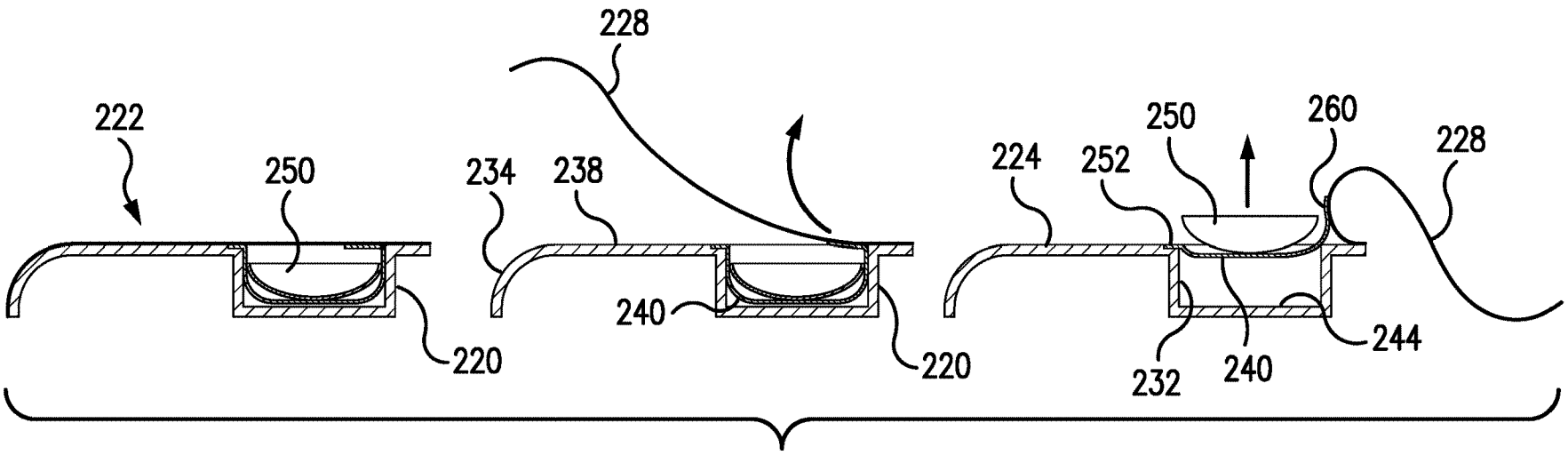

Each of FIGS. 2A and 2B illustrates the sequential steps involved with opening a blister pack 220 according to another exemplary embodiment of the present invention. FIG. 2A shows the same single blister pack 220 at three different points of time during an opening procedure. To the far left of FIG. 2A and FIG. 2B is a new, unopened, and unpeeled blister package 222. Blister package 222 comprises a body 224 and a flexible top 228 sealing a contact lens 250 within a well 232. Body 224 defines well 232 and a handle 234. In the third state shown, from the left, in both FIGS. 2A and 2B, flexible top 228 has been completely peeled back, but not removed from a top surface 238 of body 224. As can be seen in the third state from the left, a deformable slider 240 lies in a taut condition inside well 232 and has been lifter from the bottom surface 244 of well 232. As shown in the second state from the left, the deformable slider 240 conforms to the bottom of well 232 and stretches across well 232 to form a cradle on which contact lens 250 rests. One end 252 of deformable slider 240 is attached, or otherwise connected, at or near the top of the sidewall defining well 232 at the front of well 232. An opposite end 254 of deformable slider 240 is attached or otherwise connected to flexible top 228 via a hinge 260 that is designed to pull taut deformable slide 240 as flexible top 228 is peeled back from top surface 238 and away from well 232. As can be seen in the extended position illustrated in the state of the blister pack shown to the far right, deformable slide 240 is pulled taut, contact lens 250 is elevated out of well 232, and excess lens solution has drained back into the well. Hinge 260 can be made of the same material as deformable slider 240 or can be made of a different material. Hinge 260 can be made as an integral part of deformable slider 240 or can be made as a separate component and subsequently adhered or connected to deformable slider 240. The same adhesive, heat bonding, or other attachment technique can be used to attach hinge 260 to flexible top 228 as is used to attach hinge 260 to deformable slider 240, or a different attachment technique can be used.

With particular regard to FIG. 2B for which the same reference numerals as used in FIG. 2A denote the same features, the last state shows flexible top 228 peeled back completely and shows hinge 260 pulling deformable slider 240 taut. The last state shows deformable slider 240 lifted away from the bottom 244 of well 232.

As can be seen in FIGS. 2A and 2B, the proximal end of deformable slider 240, which is depicted as end of 252, can be and remain connected or otherwise attached to the proximal side of well 232 during manipulation of blister package 222 to remove flexible top 228. FIG. 2A shows proximal end 252 of deformable slider 240 attached to top surface 238 of body 224, at and adjacent the proximal side of well 232. Alternatively, proximal end 252 can be connected, adhered, bonded, or otherwise attached to the inner sidewall of well 232 at the proximal end of well 232, or to both the inner sidewall and top surface 238. Meanwhile, the distal end of deformable slider 240, which is adjacent to and/or connected at hinge 260, is connected, adhered, bonded, or otherwise attached to flexible top 228 so as to move with flexible top 228 and so as to be pulled, tensioned, stretched, and tightened as flexible top 228 is pulled-back from top surface 238 of blister package 222. While pulling back flexible top 228, it can be seen that deformable slider 240 is tensioned, pulled taut, raised-up away from bottom surface 244 of well 232, and moved into a position whereby contact lens 250 is elevated out of well 232 and presented for manipulation.

Through the steps sequentially depicted in each of FIGS. 2A and 2B, the distal end of deformable slider 240 is, and remains, indirectly connected to the distal end of body 224 through its attachment to flexible top 228. As can be seen, to the far right in FIG. 2B, deformable slider 240 stretches completely across well 232, from a proximal side to a distal side of well 232, and can be tensioned to be raised-up, away from bottom surface 244 of well 232, so contact lens 250 can be presented for manipulation.

Figure 3A:
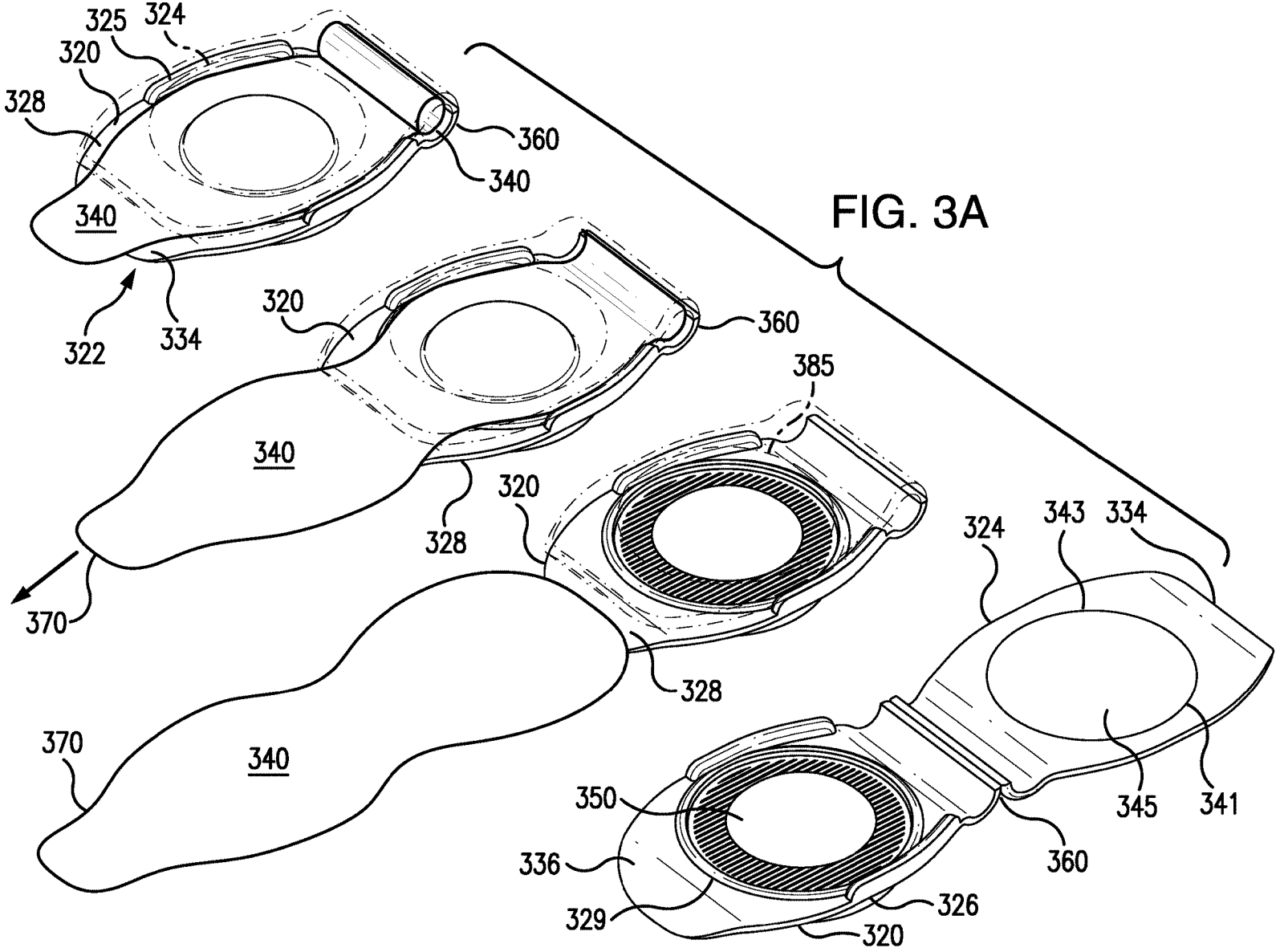
FIGS. 3A and 3B show series of steps involved with removing a deformable slider and opening a closed shell blister package according to yet other embodiments of the present invention.
Figure 3B:
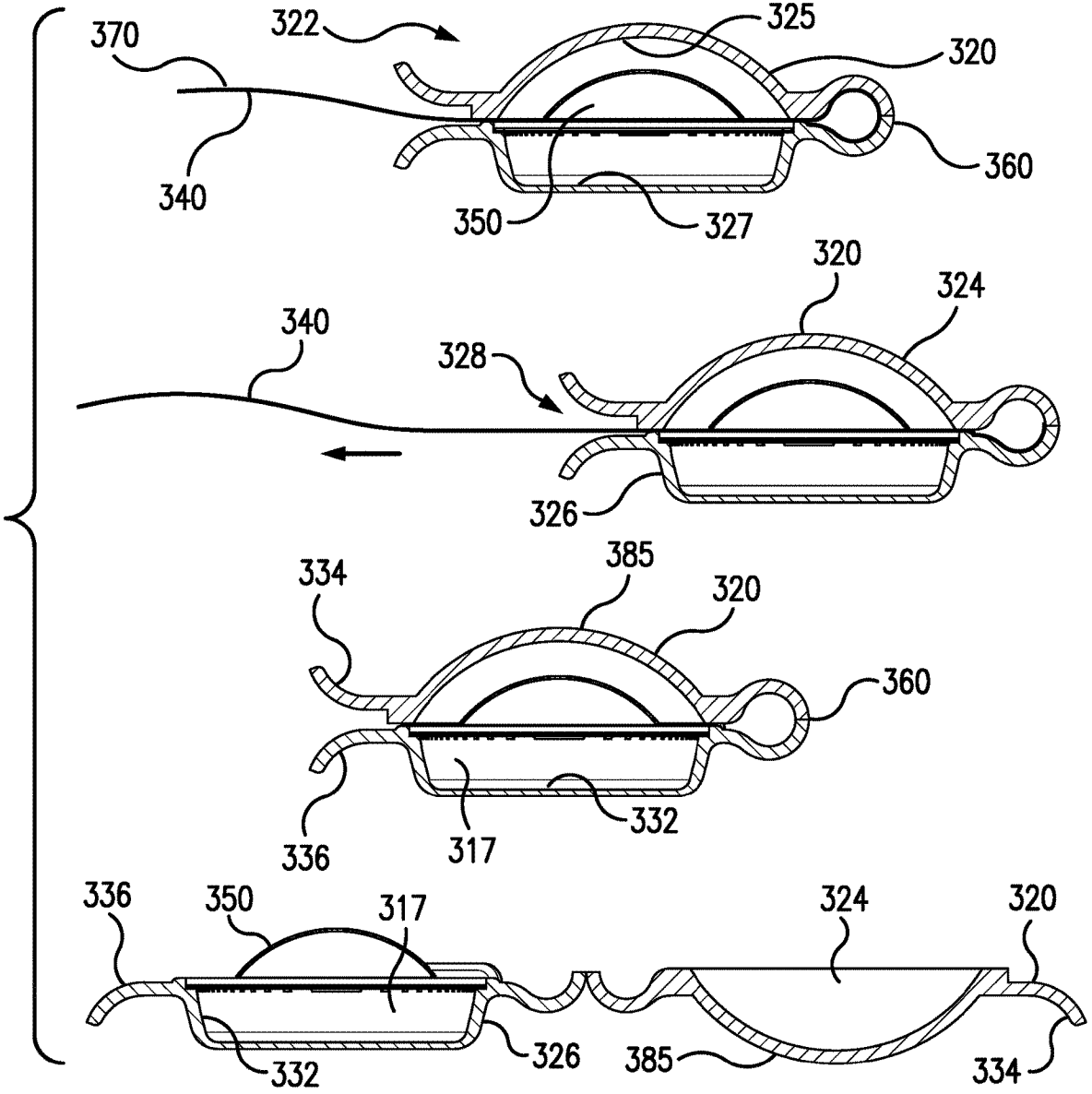
Figure 4A:
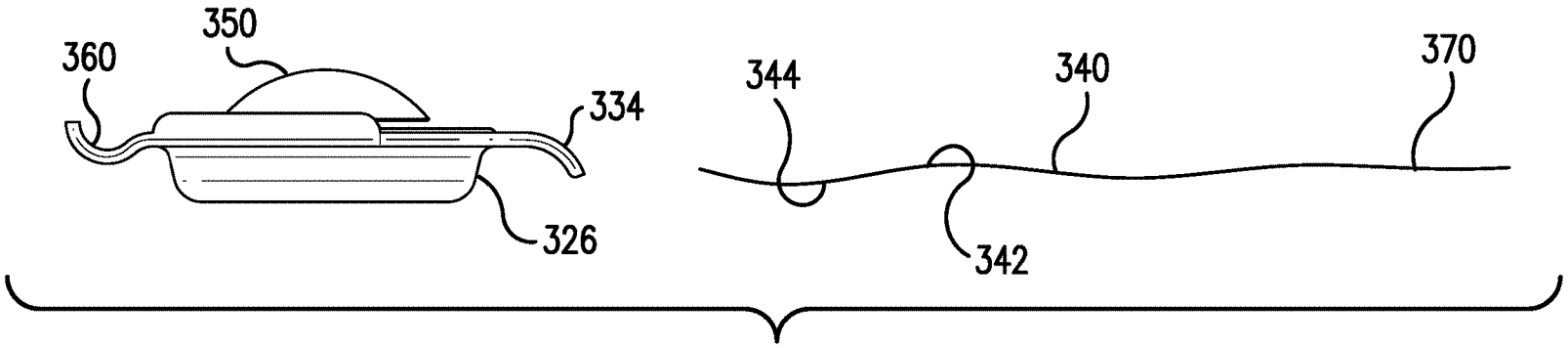
FIG. 4A is a side view of the bottom shell of the closed shell blister package shown in FIGS. 3A and 3B and showing the deformable slider removed from the blister package.
Figure 4B:
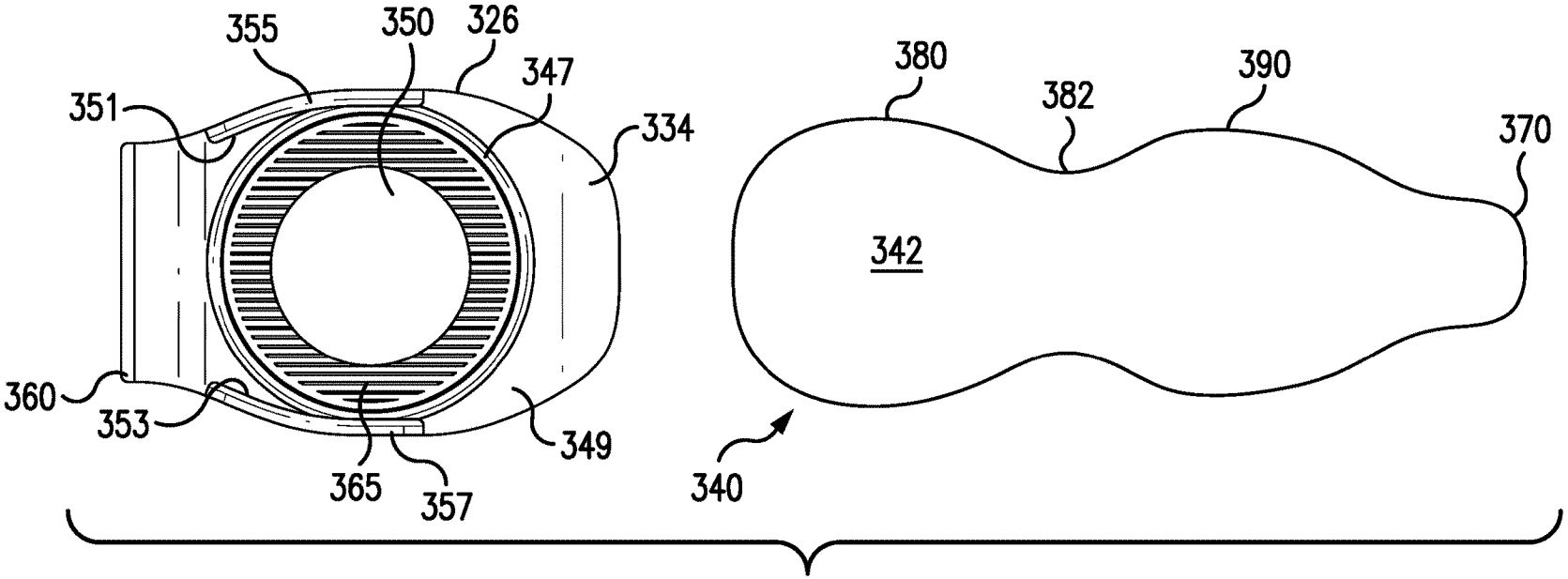
FIG. 4B is a top view of the bottom shell and deformable slider shown in FIG. 4A.

FIGS. 3A, 3B, 4A, and 4B show yet another embodiment of a contact lens blister package 320 according to the present invention. Blister package 320 comprises a hinged shell having a shell top 324 and a shell bottom 326 joined together at a deformable hinge 360. A deformable slider 340 sealed against a perimeter 343 of a well 345 formed in top shell 324, forms a sealed top chamber 325. A top surface 385 of the shell top is shown in phantom in FIG. 3A, as is the shell top. Top surface 385 is more clearly shown in FIG. 3B. As can be seen, with particular reference to FIGS. 4A and 4B, bottom surface 344 of widened portion 380 of deformable slider 340 seals against perimeter 343 of well 345. Contact lens 350 is hermetically sealed within top chamber 325. Deformable slider 340 loops around at narrowed portion 382 within hinge 360, as seen in FIG. 3A, second state from the left. Deformable slider 340 is also sealed, along bottom surface 344, at widened portion 390, against a perimeter 347 formed on an upper surface 349 of bottom shell 326. The seal forms a sealed bottom chamber 327. Once opened, an unsealed bottom chamber 317 is formed. A drainage grate 365, as seen in FIG. 4B, is provided to enable drainage of contact lens solution from top chamber 325 once the seals between deformable slider 340 and perimeters 343 and 347 are broken. Between the folded-over portions of top surface 342, an air gap is provided forms a top sealed chamber 325.

To the far left of both FIGS. 3A and 3B a new, unopened blister package 322 is shown. As can be seen in the far-left state shown in each of FIGS. 3A and 3B, new, unopened shell 322 includes an exposed tongue 370 of deformable slider 340, which sticks out of the closed shell through a lateral opening 328. Lateral opening 328 defines a gap between top shell 324 and bottom shell 326, on the side of the closed shell opposite hinge 360. A depression 329, as best seen in the far-right state shown in FIG. 3A, formed in a lower lip 336 of bottom shell 326, forms a bottom boundary of lateral opening 328. Likewise, a depression formed in an upper lip 334 of top shell 324 forms a top boundary of lateral opening 328.

As mentioned above, shell top 324 and shell bottom 326 are joined together at a deformable hinge 360. Shell top 324 and shell bottom 326 snap together to maintain a closed shell via a friction fit between an outer periphery 341 of the ridge that defines perimeter 343 of well 345, and inner surfaces 351 and 353 of ridges 355 and 357, respectively, formed on upper surface 349 of bottom shell 326.

In use, deformable slider is pulled out through lateral opening 328 and removed from the closed shell. Once deformable slider is pulled out of lateral opening 328, as shown in the third and fourth states from the left in FIGS. 3A and 3B, and as shown in FIGS. 4A and 4B, contact lens 350 falls onto and is supported by grate 365 while contacts lens solution that had been in top chamber 325 drains into well 332. Then, the unsealed closed shell, shown the third state from the left in each of FIGS. 3A and 3B, can be opened as shown the far-right state in each figure. The contact lens is then exposed and can be immediately contacted and transferred by a fingertip.

The present invention includes the following aspects/embodiments/features in any order and/or in any combination:

1. A blister package for a contact lens, the blister package comprising:
   - a body, the body comprising a handle, a well connected to the handle, and a body top surface, the well having a perimeter and an inner sidewall defining a bottom surface;
   - a flexible top contacting the body top surface around the perimeter of, and closing, the well, the flexible top having a peel tab and being peel-able away from the body to open the well; and
   - a deformable slider comprising a lens support, wherein the deformable slider is disposed between the body and the flexible top, the lens support is disposed in the well and adjacent the bottom surface, and the deformable slider is configured such that, by pulling the deformable slider, the lens support is lifted away from the bottom surface.

2. The blister package of any preceding or following embodiment/feature/aspect, wherein the deformable slider is connected to both the flexible top and the lens support.

3. The blister package of any preceding or following embodiment/feature/aspect, wherein the deformable slider further comprises a hinge, wherein the hinge is connected to both the flexible top and the lens support.

4. The blister package of any preceding or following embodiment/feature/aspect, wherein the blister package is configured such that, by peeling the flexible top away from the body, the hinge is pulled taut causing the lens support to be lifted away from the bottom surface.

5. The blister package of any preceding or following embodiment/feature/aspect, wherein the peel tab of the flexible top contacts the body on a first side of the well, the hinge is connected to the flexible top adjacent a second side of the well, the second side is opposite the first side, and the blister package is configured such that, by peeling the flexible top away from the body, the well is exposed prior to the hinge being pulled taut and pulling the flexible top in a direction from the first side to the second side causes the lens support to be lifted away from the bottom surface.

6. The blister package of any preceding or following embodiment/feature/aspect, wherein the deformable slider comprises a unitary sheet of material.

7. The blister package of any preceding or following embodiment/feature/aspect, wherein the deformable slider is separate from the flexible top and peeling the flexible top away from the body exposes the deformable slider.

8. The blister package of any preceding or following embodiment/feature/aspect, wherein the deformable slider further comprises a pull tab, the flexible top is sealed to the body top surface with the pull tab sealed between the body top surface and the flexible top, and the pull tab is configured such that, after opening the blister package by peeling away the flexible top to expose the pull tab, the pull tab can be pulled to pull taut the deformable slider and lift the lens support.

9. The blister package of any preceding or following embodiment/feature/aspect, wherein the pull tab comprises a rail, the body comprises a groove, the rail is slidable in the groove, and the pulling the pull tab comprises sliding the rail of the pull tab in the groove.

10. The blister package of any preceding or following embodiment/feature/aspect, wherein the lens support has a circular shape and a diameter and comprises a compressible foam material.

11. The blister package of any preceding or following embodiment/feature/aspect, wherein the deformable slider comprises a foil material.

12. The blister package of any preceding or following embodiment/feature/aspect, wherein each of the flexible top and the deformable slider independently comprises a foil material.

13. The blister package of any preceding or following embodiment/feature/aspect, further comprising a contact lens in the well and supported by the lens support.

14. A method comprising:

placing a contact lens into a well of a blister package, on top of a lens support of a deformable slider, the blister package comprising a body having a handle, a well connected to the handle, and a body top surface, the well having a perimeter and an inner sidewall defining a bottom surface; and sealing a flexible top to the body top surface to seal the well with the contact lens therein on top of the lens support, the sealing comprising sealing the flexible top such that the flexible top contacts the body top surface around the perimeter of the well and closes the well, the flexible top having a peel tab and being peelable away from the body to open the well, wherein the lens support is disposed in the well and adjacent the bottom surface, and the deformable slider is configured such that, by pulling the deformable slider, the lens support is lifted away from the bottom surface.

15. The method of any preceding or following embodiment/feature/aspect, wherein the deformable slider further comprises a hinge, the hinge is connected to the both the lens support and to the flexible top, and the method further comprises pulling the pull tab to (1) peel the flexible top away from the body top surface, (2) open the well, (3) pull taut the hinge, and (4) lift the lens support away from the bottom surface.

16. The method of any preceding or following embodiment/feature/aspect, further comprising:

opening the blister package by peeling away the flexible top; and pulling taut the deformable slider to lift the lens support.

17. The method of any preceding or following embodiment/feature/aspect, wherein the deformable slider is connected to the flexible top, and the method further comprises pulling the pull tab to peel away the flexible top from the body top surface and lift the lens support away from the bottom surface.

18. The method of any preceding or following embodiment/feature/aspect, wherein the deformable slider further comprises a pull tab, the sealing the flexible top to the body top surface comprises sealing the pull tab between the body top surface and the flexible top, and the method further comprises:

opening the blister package by peeling away the flexible top; and pulling the pull tab to pull taut the deformable slider and lift the lens support.

19. The method of any preceding or following embodiment/feature/aspect, wherein the pull tab comprises a rail, the body comprises a groove, the rail is slidable in the groove, and the pulling the pull tab comprises sliding the rail of the pull tab in the groove.

20. A blister package for a contact lens, the blister package comprising:

a hinged shell comprising a shell bottom, a shell top, and a hinge connecting the shell bottom to the shell top, the shell bottom having a bottom inner sidewall that partially defines a bottom chamber, and a bottom chamber perimeter surface intersecting with the bottom inner sidewall, the shell top having a top inner sidewall that partially defines a top chamber, and a top chamber perimeter surface intersecting with the top inner sidewall, the hinged shell being configured such that the shell bottom and the shell top can be closed together to form a closed shell having a lateral opening;

a deformable slider folded over onto itself at a fold, being substantially enclosed in the closed shell, and comprising a bottom surface and a tongue, the bottom surface sealing the bottom chamber at the bottom chamber perimeter surface, being folded over, and sealing the top chamber at the top chamber perimeter surface, the tongue extending from the lateral opening of the closed shell; and a lens support in the bottom chamber.

21. The blister package of any preceding or following embodiment/feature/aspect, wherein the deformable slider comprises a foil material.

22. The blister package of any preceding or following embodiment/feature/aspect, wherein the deformable slider comprises a unitary sheet of material.

23. The blister package of any preceding or following embodiment/feature/aspect, further comprising a contact lens sealed within the top chamber.

24. The blister package of any preceding or following embodiment/feature/aspect, further comprising a contact lens sealed within the top chamber, wherein the lens support comprises a drain and the blister package is configured such that, by pulling the tongue through the lateral opening, the seal between the deformable slider and the top chamber perimeter surface is broken, the seal between the deformable slider and the bottom chamber perimeter surface is broken, the contact lens solution drains into the bottom chamber, and the closed shell can be opened to present the contact lens on the lens support above the bottom chamber.

25. A method comprising:

disposing a contact lens on a lens support, and contact lens solution, in a top chamber of a blister package, the blister package comprising a hinged shell comprising a shell bottom, a shell top, and a hinge connecting the shell bottom to the shell top, the shell bottom having a bottom inner sidewall that partially defines a bottom chamber, and a bottom chamber perimeter surface intersecting with the bottom inner sidewall, the shell top having a top inner sidewall that partially defines the top chamber, and a top chamber perimeter surface intersecting with the top inner sidewall, the hinged shell being configured such that the shell bottom and the shell top can be closed together to form a closed shell having a lateral opening, a deformable slider folded over onto itself at a fold, being substantially enclosed in the closed shell, and comprising bottom surface and a tongue, the bottom surface sealing the bottom chamber at the bottom chamber perimeter surface, being folded over, and sealing the top chamber at the top chamber perimeter surface, the tongue extending from the lateral opening of the closed shell, and a lens support in the bottom chamber;

sealing the deformable slider to the top chamber perimeter surface and to the bottom chamber perimeter surface, to form a sealed blister package; and closing the shell bottom and the shell top together to form a closed shell having a lateral opening.

26. The method any preceding or following embodiment/feature/aspect, further comprising pulling on the tongue to pull the deformable slider out of the lateral opening, and opening the hinged shell.

27. The method any preceding or following embodiment/feature/aspect, wherein the lens support comprises a drain and the method further comprises:

pulling the tongue to pull the deformable slider out of the closed shell, through the lateral opening, to (1) break the seal between the deformable slider and the top chamber perimeter surface, (2) break the seal between the deformable slider and the bottom chamber perimeter surface, and (3) drain the contact lens solution into the bottom chamber; and opening the closed shell to present the contact lens on the lens support in the bottom chamber.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A blister package for a contact lens, the blister package comprising:

a body, the body comprising a handle, a well connected to the handle, and a body top surface, the well having a perimeter, an inner sidewall defining a bottom surface, a distal side, and a proximal side opposite the distal side, the proximal side being adjacent to the handle;

a flexible top contacting the body top surface around the perimeter of, and closing, the well, the flexible top having a peel tab contacting the body on the proximal side of the well, the flexible top being peelable away from the body by the peel tab to open the well; and a deformable slider comprising a lens support, wherein the deformable slider is disposed between the body and the flexible top, and the deformable slider has an end that is connected to either the body top surface or the well at the proximal side of the well, adjacent to the handle, and the lens support is disposed in the well and adjacent the bottom surface, and the deformable slider is configured such that, by pulling the deformable slider, the lens support is lifted away from the bottom surface.

2. The blister package of claim 1, wherein the deformable slider is connected to both the flexible top and the lens support.

3. The blister package of claim 1, wherein the deformable slider further comprises a hinge, wherein the hinge is connected to both the flexible top and the lens support.

4. The blister package of claim 3, wherein the blister package is configured such that, by peeling the flexible top away from the body, the hinge is pulled taut causing the lens support to be lifted away from the bottom surface.

5. The blister package of claim 4, wherein the hinge is connected to the flexible top adjacent the distal side of the well, and the blister package is configured such that, by peeling the flexible top away from the body, the well is exposed prior to the hinge being pulled taut and pulling the flexible top in a direction from the proximal side to the distal side causes the lens support to be lifted away from the bottom surface.

6. The blister package of claim 1, wherein the deformable slider comprises a foil material.

7. The blister package of claim 1, wherein each of the flexible top and the deformable slider independently comprises a foil material.

8. The blister package of claim 1, further comprising a contact lens in the well and supported by the lens support.

9. A method comprising:

placing a contact lens into a well of a blister package, on top of a lens support of a deformable slider, the blister package comprising a body having a handle, a well connected to the handle, and a body top surface, the well having a perimeter, an inner sidewall defining a bottom surface, a distal side, and a proximal side opposite the distal side, the proximal side being adjacent to the handle; and sealing a flexible top to the body top surface to seal the well with the contact lens therein on top of the lens support, the sealing comprising sealing the flexible top such that the flexible top contacts the body top surface around the perimeter of the well and closes the well, the flexible top having a peel tab contacting the body on the proximal side of the well, the flexible top being peelable away from the body by the peel tab to open the well, wherein the lens support is disposed in the well and adjacent the bottom surface, and the deformable slider is configured such that, by pulling the deformable slider, the lens support is lifted away from the bottom surface and the deformable slider has an end that is connected to either the body top surface or the well at the proximal side of the well, adjacent to the handle.

10. The method of claim 9, wherein the deformable slider further comprises a hinge, the hinge is connected to the both the lens support and to the flexible top, and the method further comprises pulling the pull tab to (1) peel the flexible top away from the body top surface, (2) open the well, (3) pull taut the hinge, and (4) lift the lens support away from the bottom surface.

11. The method of claim 9, further comprising:

opening the blister package by peeling away the flexible top; and pulling taut the deformable slider to lift the lens support.

12. The method of claim 9, wherein the deformable slider is connected to the flexible top, and the method further comprises pulling the pull tab to peel away the flexible top from the body top surface and lift the lens support away from the bottom surface.

* * * * *